United States Patent [19]

Frye

[11] 3,996,707

[45] Dec. 14, 1976

[54] GROUND ANCHOR FOR VOLLEYBALL AND LIKE GAMES

[76] Inventor: Norman V. Frye, R.R. 4, Davenport, Iowa 52804

[22] Filed: May 24, 1976

[21] Appl. No.: 689,059

[52] U.S. Cl. ..... 52/157; 248/156

[51] Int. Cl.[2] ..... E02D 5/74; A45F 3/44

[58] Field of Search ..... 52/155, 157; 248/156

[56] References Cited

UNITED STATES PATENTS

| | | | |
|---|---|---|---|
| 3,076,532 | 2/1963 | Frye | 52/157 |
| 3,197,928 | 8/1965 | Frye | 52/157 |
| 3,328,928 | 7/1967 | Frye | 52/157 |
| 3,636,670 | 1/1972 | Frye | 52/157 |

FOREIGN PATENTS OR APPLICATIONS

| | | | |
|---|---|---|---|
| 581,915 | 10/1946 | United Kingdom | 248/156 |

*Primary Examiner*—James L. Ridgill, Jr.

[57] ABSTRACT

A preferably one-piece rod-like member of generally Z shape having a depending helix for screwing into the ground, a leg adapted to overlie the ground and a post-supporting part rising vertically from the leg in spaced relation to the depending helix, the leg being so related to the helix and post-supporting parts as to be stressed when the helix is screwed finally into the ground.

7 Claims, 7 Drawing Figures

GROUND ANCHOR FOR VOLLEYBALL AND LIKE GAMES

BACKGROUND OF THE INVENTION

The basic prior designs upon which the present invention is an improvement are represented by the present applicant's U.S. Pat. Nos. 3,076,532; 3,197,938; 3,328,928; and 3,636,670. Although each of these designs was an improvement over what had gone before, further experience has proved the need for improvement, especially in the areas of durability, flexibility, ease of installation and use and economy of manufacture.

It may be accepted that volleyball, when skillfully played, is one of the most rugged of net games, and the net and posts supporting the net are subjected to forces tending to tilt the posts in all directions. Consequently, and particularly in a situation where the erection of the net is to be portable, the ground anchors must be easy to install, they must be durable to withstand the forces arising during play and they must be flexible and capable of rapidly recovering their initial or normal status.

The most closely related of applicant's prior U.S. Patents are Nos. 3,636,670 and 3,328,928, each of which discloses generally a member in the form of a Z in which one part is a ground-penetrating helix, a second part is a leg adapted to overlie the ground and a third part is an upright (or nearly so) post-receiving part. In No. 3,328,928, the junction of the leg and helix is substantially a right angle, so that the leg, overlying the ground, has no pre-stress. In 3,636,670, although the junction of the leg and helix is less than 90° and the ground-overlying leg inclines downwardly from the top of the helix to the ground, the purpose of the inclination is not to pre-stress the leg but to keep the top of the helix above ground. The absence of pre-stress is further shown by the built-in tilt of the post-receiving part; i.e., that part tilts toward the helix axis extended so that when the net is tensioned via the post carried by the post-supporting part the latter tends to be moved to a vertical position.

According to the present invention, and having resort to a specific embodiment by way of explanation, the ground-penetrating and post-receiving parts lie on parallel axes and the leg extends at angles of less than 90° to each. The purpose of this design is to enable pre-stressing or loading of the leg as the anchor is screwed into the ground to its final position. That is to say, the helix is started vertically into the ground, with the leg and post-receiving part being used as a crank or handle, until the bottom of the leg at the junction thereof with the post-receiving part initially contacts the ground. This means that the top of the helix will still be somewhat above the ground and the leg will incline downwardly and away from this top part. The leg is then manually lifted (being flexible) and the anchor is cranked deeper into the ground until the leg lies flat on the ground. The leg is thus stressed or loaded and the initially vertical post-supporting part is caused to tilt toward the helix axis extended. Then, when net tension is applied to the post carried by the post-receiving part, the leg is further loaded or stressed, thus giving a greater net tension than was heretofore attainable.

Other advantages flowing from this construction are that the leg, lying flat-wise on the ground, presents a substantially horizontal torque member; i.e., the forces applied to the post in a plane normal to the leg rock or twist the leg about a horizontal rather than an inclined axis; the top of the helix, being flush with the ground, does not present an obstacle over which some person could trip; the pre-stressed leg more tightly grips the ground and further resists twisting of the anchor about the helix axis; the tighter grip of the ground by the leg eliminates the need for stabilizers and the like, as the enlarged lower end of the post-supporting part in No. 3,636,670 or the wings of No. 3,328,928.

Even when used as a tie-down — i.e., without the post-receiving part — the present design affords many advantages; e.g., elimination of high or above-ground obstacles and tighter leg-to-ground gripping action.

DESCRIPTION OF A PREFERRED EMBODIMENT

Figure 1:
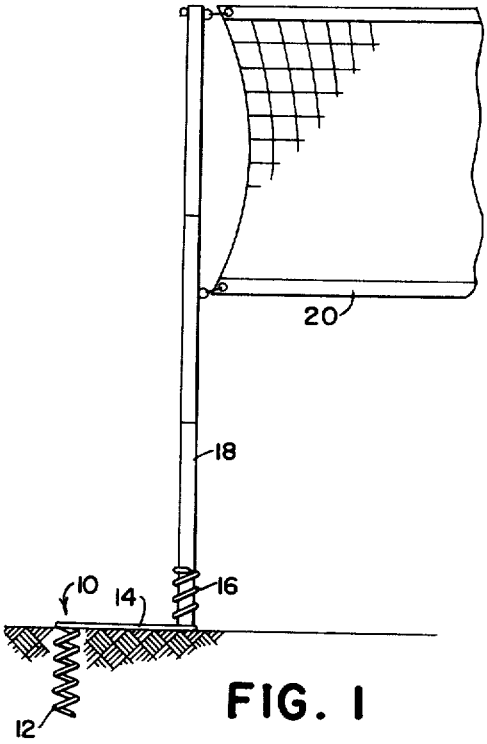
FIG. 1 is a fragmentary "environmental" view, showing the anchor used in a volleyball background.

The ground anchor is designated in its entirety by the numeral 10 as having a ground-penetrating portion 12, an above-ground leg 14 and a post-receiving or -supporting part 16 which receives a post 18 for carrying one end of a volleyball net 20, it being understood that the other end of the net is similarly supported; i.e., the anchors are used in pairs.

Figure 4:
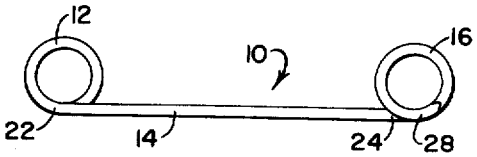
FIG. 4 is a top plan view of FIG. 2.

Preferably the member 10 is of one-piece, rod-like construction, being formed of steel having the requisite resiliency and ability to recover its original form over long periods of use. The rod-like material is normally on the order of about one-half inch in circular cross section. This type of rod lends itself to simple and rapid manufacture, especially when it is considered that the parts 12 and 16 are helices respectively having junctions at 22 and 24 with the leg 14. As best shown in FIG. 4, each junction of the leg is tangential to its associated helix, the junction 22 being at the top turn of the helix 12 and the junction 24 being at the bottom turn of the helix 24. The leg 14 is straight in its extent between the junctions, thus simplifying manufacture. The terminal end of the helix 12 is pointed at 26 to facilitate its use as screw means for entering the ground, and the top of the helix 16 terminates at 28 in a plane normal to the axis of that helix so as to eliminate a projection. The helices have the same diameter and pitch, thus making the anchors easier to fabricate.

Figure 2:
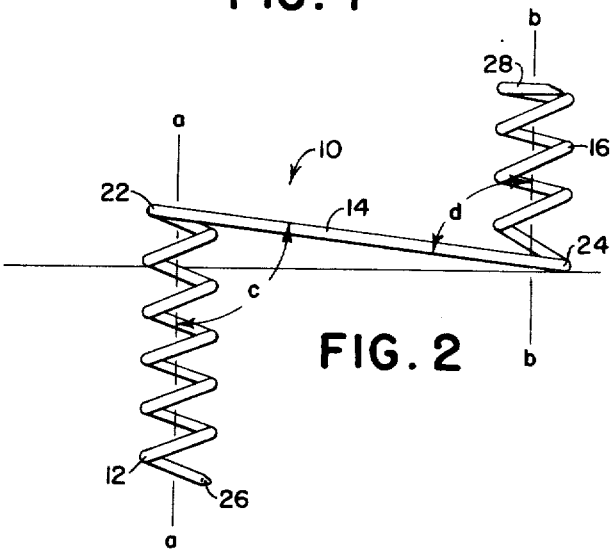
FIG. 2 is a view of the anchor per se as initially screwed into the ground.

FIG. 2 shows the anchor in its free state, which is also the state it occupies when it is screwed into the ground to an extent in which the junction 24 initially contacts the ground. The axes *a—a* and *b—b* of the helices 12 and 16, respectively are parallel. The leg forms an angle *c* with the axis *a—a* and an angle *d* with the axis *b—b*. Both angles are slightly less than 90°, preferably 70°–80°. Thus, in the position of FIG. 2, the leg inclines downwardly from the junction 22 to the ground at the junction 24, leaving a top portion of the helix 12 exposed above the ground.

At this point or status, the leg is not pre-stressed. Although the anchor could be used in this position, it would present many disadvantages. First, the helix 12 is not screwed all the way into the ground, leaving the top portion thereof and the related part of the leg above ground as an obstacle. Second, the helix 16 is vertical and when tension is applied by the net to the associated post, the tops of the paired posts would converge upwardly, which is not desirable. Third, the leg is not stressed and thus has only limited frictional contact with the ground, with the result that the anchor could twist about the axis *a—a*. Fourth, the twisting or torque axis of the leg is not horizontal and forces applied to the net and posts in directions lengthwise of the court would cause the tops of the posts to converge still further.

Figure 3:
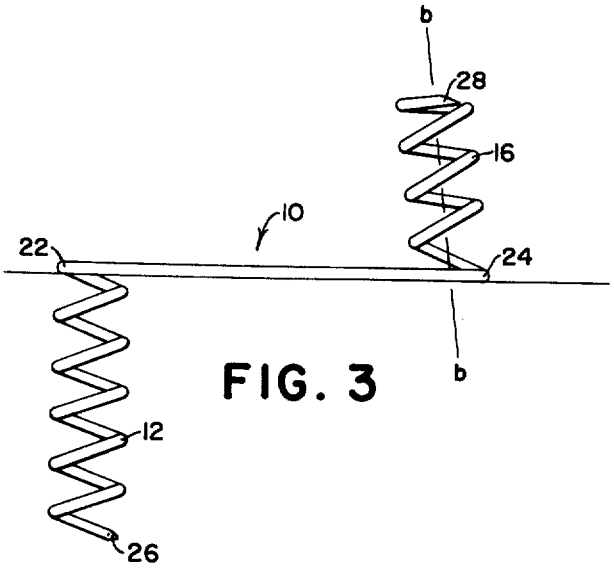
FIG. 3 is a similar view but shows the anchor in its final position.

These disadvantages are eliminated by screwing the anchor deeper to the ultimate or final position as shown in FIG. 3. This is achieved by the user's applying a lifting force to the leg 14 via the helix 16 as a handle and then screwing the helix 12 deeper into the ground until the leg lies flat on the ground. Then the anchor, apart from the helix 16, is substantially flush with the ground or at least eliminates the afore-mentioned obstacle. What is more, the leg is now pre-stessed. Further, the helix is caused to tilt toward the axis *a—a* extended. When the posts 18 are first installed, they tend to diverge upwardly, but tensioning the net 20 properly draws the posts into upright parallelism, further stressing the legs 14. The legs now lie horizontally and when twisting in response to forces applied lengthwise of the court cause the posts to retain parallelism or substantial parallelism.

The material of which the anchor is constructed is such that despite the forces applied to the anchor, whether in torsion or bending, the anchor is capable of recovering its position of FIG. 3. When the anchor is removed from the ground, it recovers its position as shown in FIG. 2. The anchor will withstand repeated use and abuse without taking a "set".

Figure 7:
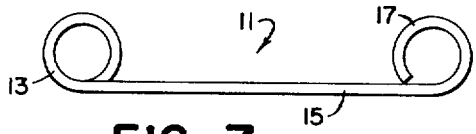
FIG. 7 is a top plan view of FIG. 6.
Figure 5:
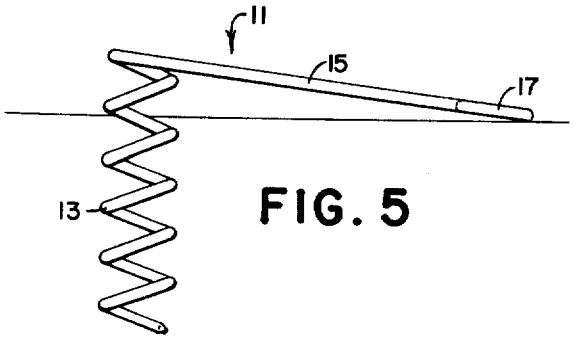
FIG. 5 is a view of a tie-down, in elevation and in preliminary position.
Figure 6:
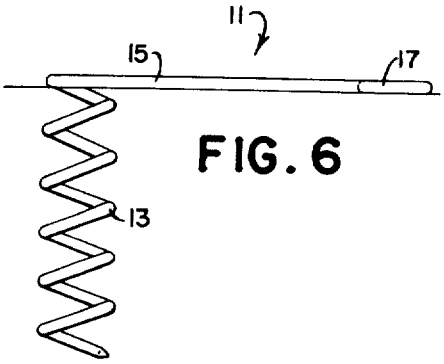
FIG. 6 is a similar view but showing the final position of the anchor of FIG. 5.

In a modified form of the invention, the same basic principles are applied to a tie-down, as shown at 11 in FIGS. 5, 6 and 7. In this case the helix 13 has a leg 15 terminating remote from the helix as a rope-receiving loop 17. The angle at the junction of the leg 15 with the top of the helix 13 is the same as that described above, giving the advantages of a final position in which the leg lies flat on the ground (FIG. 6), increasing the grip of the leg with the ground and eliminating obstructions. The member 11 is preferably of one-piece, rod-like steel as above described, and other similarities will be apparent without further elaboration.

I claim:

1. A ground anchor and post-supporting member of generally Z-shaped construction having a depending part disposed on a vertical axis and including screw means for screwing into the ground, a leg part having a fixed junction with the top of the depending part and extending away and downwardly therefrom at an angle of slightly less than ninety degrees and adapted to overlie the ground, and an upright part having a fixed junction with and arising from the end of the leg remote from the depending part and disposed initially on a vertical axis, the junction of the upright part with the leg likewise forming an angle of slightly less than 90°, the leg being straight in its extent between the junctions so that, when the depending part is screwed vertically into the ground to the point where the junction of the leg and the upright part initially contacts the ground, the leg inclines downwardly from the top of the depending part to the bottom of the upright part and the axes of the two parts are parallel, said leg being flexible in bending to enable manual lifting of the leg for further screwing of the depending part into the ground to a position in which the leg lies flat on the ground and the upright part tilts toward the depending part axis extended, said upright part being constructed to receive and support a post, and the flexibility of the leg being such as to enable the post to be moved forcibly to a vertical position and beyond, the leg being resilient so as to recover its flat-wise position with the upright part tilted as aforesaid when the force is removed from the post, said leg being also torsionally resilient to enable the upright part to be rocked in a plane normal to the axis of the flat-wise leg.

2. The invention defined in claim 1, in which the screw means in a helix formed about a vertical axis and depending from the leg at the aforesaid junction.

3. The invention defined in claim 2, in which the leg is integral with the helix and extends tangentially from the top turn thereof.

4. The invention defined in claim 1, in which the upright part is a helix formed about a vertical axis and rising from the aforesaid junction with the leg.

5. The invention defined in claim 4, in which the leg is integral with and extends tangentially from the lower turn of the upright helix.

6. The invention defined in claim 1, in which the member is of one-piece rod-like construction, the screw means is a helix formed about a vertical axis and depending from the aforesaid junction with the leg, the upright part is a helix formed about a vertical axis and rising from the aforesaid junction with the leg, and the leg extends tangentially to the respective upper and lower turns and is straight between said junctions.

7. The invention defined in claim 6, in which the top turn of the upright helix terminates in a plane normal to that helix axis.

* * * * *